US005378503A

United States Patent [19]

Kohler et al.

[11] Patent Number: 5,378,503

[45] Date of Patent: Jan. 3, 1995

[54] ADJUSTABLE BLADE COATER

[75] Inventors: Herbert B. Kohler, Uniontown; Michael L. Schmidt, North Canton, both of Ohio

[73] Assignee: The Kohler Coating Machinery Corporation, Greentown, Ohio

[21] Appl. No.: 66,523

[22] Filed: May 24, 1993

Related U.S. Application Data

[62] Division of Ser. No. 924,838, Aug. 4, 1992, Pat. No. 5,242,498.

[51] Int. Cl.[6] ..... B05D 3/12

[52] U.S. Cl. ..... 427/356; 427/361; 118/126; 118/413; 118/674; 118/681

[58] Field of Search ..... 118/126, 413, 681, 674; 427/356, 361

[56] References Cited

U.S. PATENT DOCUMENTS

| | | | |
|---|---|---|---|
| 3,683,851 | 8/1972 | Nolden | 118/126 |
| 4,220,113 | 9/1980 | Wohlfeild . | |
| 4,233,930 | 11/1980 | Wohlfeil | 118/413 |
| 4,375,202 | 3/1983 | Miller | 118/126 |
| 4,880,672 | 11/1989 | Ericksson | 427/356 |
| 4,907,528 | 3/1990 | Sollinger | 118/126 |
| 4,966,093 | 10/1990 | Sommer | 118/126 |
| 5,035,196 | 7/1991 | Mannio | 427/356 |
| 5,138,970 | 8/1992 | Sollinger | 427/356 |
| 5,221,351 | 6/1993 | Esser et al. | 427/356 |

*Primary Examiner*—Shrive Beck
*Assistant Examiner*—Brian K. Talbot
*Attorney, Agent, or Firm*—Pearne, Gordon, McCoy & Granger

[57] ABSTRACT

A web coater is provided with a doctor blade having an active edge or tip engaging the web at a predetermined position. The force applied by such active edge is adjusted by movement of jaws gripping the opposite edge of the blade. The jaws are moved along a curve empirically established to maintain the active edge of the blade in a predetermined fixed position during the adjustment. The angle of incidence of the active edge of the blade relative to the web is also maintained constant by pivoting a blade supporting frame about an axis coincident with the active edge. A controller is supplied with empirically established data developed by utilizing test blades to establish polynomial formulas having constants corresponding to each of the various blades intended to be used by the coater. The controller also automatically compensates for blade wear.

8 Claims, 2 Drawing Sheets

Fig. 3
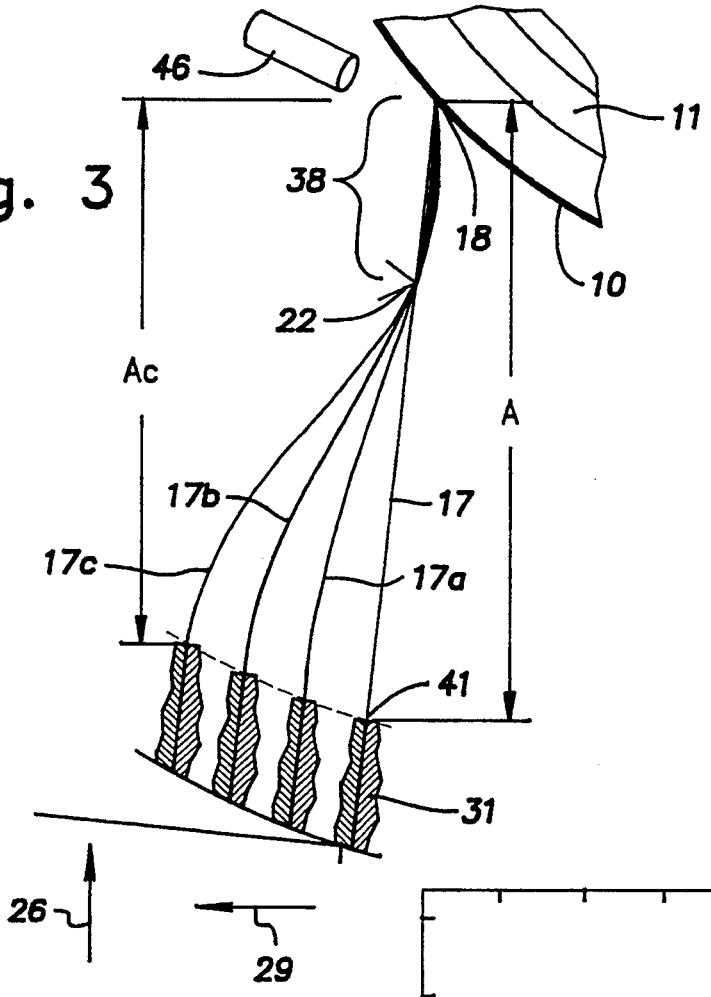
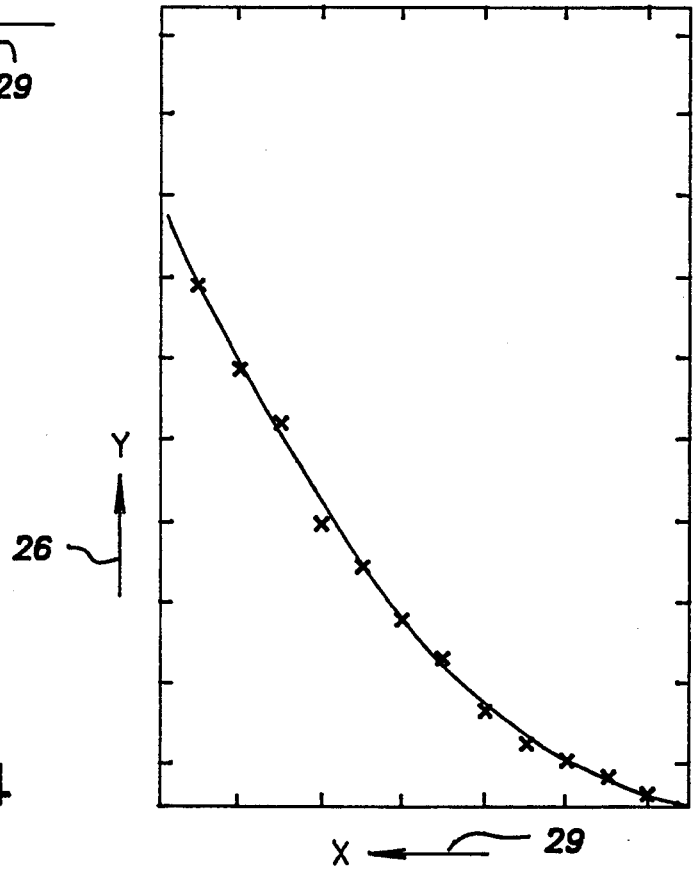
Fig. 4

ADJUSTABLE BLADE COATER

This is a division of application Ser. No. 07/924,838, filed Aug. 4, 1992.

BACKGROUND OF THE INVENTION

This invention relates generally to the coating of web materials, such as paper, and more particularly, to a novel and improved adjustable blade coater providing a constant blade angle and tip position and method of programming such coaters.

PRIOR ART

The pressure of the tip or active edge of a coater blade should be adjustable to produce a desired web coating. Further, a stable condition is required for high quality coatings.

If changes of the blade pressure result in changes of the tip angle or the location of the tip relative to the web, an unstable condition occurs. The blade will run either on its heel or tip. Such unstable condition continues until the blade edge is honed by its contact with the web back to a matching condition with respect to the web causing a return to a stable condition. The quality of the coating is inferior until a stable condition returns.

In order to eliminate such unstable conditions with its resulting inferior coatings, systems have been devised which attempt to maintain the constant blade tip angle and position even when the tip pressure of the blade is adjusted.

One such system is described in the U.S. Pat. No. 4,220,113. Such system provides a fulcrum which engages the blade at a location close to but spaced from the active edge of the blade in combination with jaws which clamp the other edge of the blade.

The jaws are moveable relative to the fulcrum with translating movement to adjust the pressure exerted by the active edge of the blade on the web to modify the coating produced. Such movement of the jaws deforms the blade to an "S" shape. In an attempt to maintain the location and tip angle constant during the jaw movement, such patent discloses the deflection of blade by linear movement of the jaw in a direction which extends at an acute angle with respect to the plane of the undeflected blade. The angle of this linear or straight line movement of the jaws is intended to compensate for changes in the effective blade length as it is deflected to the "S" shape by the jaw movement. Such patent is incorporated herein in its entirety to illustrate at least one prior art attempt to maintain a constant blade tip position and angle.

Because the jaw movement is linear rather than along a curve, the system of such patent only approximates correct adjustment movement and is effective only when small jaw movements are provided. Therefore, such system is optimized for only one, or at most, a small number of blade tip lengths. Further, such system required the use of relatively stiff and short blades so that the required range of pressure adjustment can be accomplished with a small amount of jaw movement.

Such stiff blades are undesirable since they tend to cause web breakage if web imperfections, such as holes in the web, are encountered.

SUMMARY OF THE INVENTION

There are a number of aspects to the present invention. In accordance with one important aspect of the present invention, an apparatus includes a fulcrum which engages the coating blade at a location spaced from the tip or active edge of the blade in combination with blade clamping jaws which grip the opposite edge of the blade. The jaws are moveable during blade pressure adjustment to deflect the blade to a "S" shape and adjust the pressure exerted at the active edge of the blade. The jaw movement is along a curve which is selected to precisely compensate the changes of the effective length of the blade so as to maintain the active edge of the blade in a precisely constant position. Further, the adjustment is arranged to also maintain a constant angle of the blade relative to the web at the active edge or tip. When a blade of different dimensions is used, the jaw movement curve is changed to again provide precise compensation for the change in effective blade length so as to maintain the operative edge location and angle constant.

With this invention, empirically established curves are provided for the adjustment of each type of blade intended to be used. Because the adjustment of the pressure of the blade tip is accurately matched to a particular blade then in use, a greater range of adjusting movements is possible. Therefore, wider and thinner blades can be used. Such thinner blades are more flexible and less likely to break or otherwise damage a web when a flaw in the web passes the blade. Further, thinner blades have a smaller cross-sectional area in contact with the coated web. For a given blade load, this provides higher unit shear forces and results in improved coated surface properties.

In the illustrated embodiment, the blade is installed while undeflected with the active edge or tip against the web, one side of the blade is against the fulcrum spaced from the active edge, and the other edge is clamped between the jaws. The jaws are mounted for movement in two directions extending at an angle relative to each other. In the illustrated embodiment, one direction of jaw movement is perpendicular to the plane of the undeflected blade, and the other direction of blade movement is parallel to such plane. A controller is provided to control the relationship between the two movements so that the jaws move along a curve which accurately compensates for the changes in effected blade length caused by deflection of the blade to an "S" shape. The curve of jaw movement causes the active edge of the blade to remain in exactly the same position as the jaws move to adjust the blade pressure. Further, the fulcrum and the jaws are mounted on a frame pivoted for movement about an axis coincident with the point of engagement of the active blade edge and the web. This frame is pivoted about such axis to maintain the angle of incidence of the active end of the blade constant as the adjustments occur. Here again, the controller operates to control this pivoted movement based on empirically established data.

Another aspect of this invention is the provision of automatic compensation for blade wear. The amount of blade wear tends to be a function of the length of the web which is moved past the blade during the coating operation. In accordance with the present invention, means are provided to establish the length of web passing the blade and to advance the blade as the coater is running as a function of the linear footage passing the blade. Depending upon tip length, blade wear compensation from 0.08 inches to 0.18 inches is easily accomplished. In most cases, this means the doubling or tripling of blade life.

In accordance with still another aspect of this invention, a method has been developed to empirically establish the curve of movement of the jaws which will maintain each blade in a constant position. These curves have been established by extensive testing with full scale models and field testing.

It has been determined that a blade loaded in a first direction against a fulcrum point can be compensated for by curved movement created by jaw movement in such first direction combined with movement in a second direction perpendicular to such first direction when the relationship of the first and second movements is best described by a third, or in some cases, fourth order polynomial. These polynomials take the following form:

$Y=AX^3+BX^2+CX+D$ for a third order polynomial and $Y=AX^4+BX^3+CX^2+DX+E$ for a fourth order polynomial when X and Y represent the amounts of the first and second movements.

A different loading curve is required whenever:

a. The blade extension (the distance between the fulcrum and active edge) is changed;

b. The distance between the jaws and active edge of an unstressed blade is changed;

c. The blade thickness is changed; or d. The blade wears.

After points along each curve are empirically plotted, the points are supplied to a computer programmed to establish the corresponding curve formula and constants. The constants are then stored within a controller computer. The controller is programmed to apply the proper curve constants for the controlling of the jaw movement in the X and Y directions for the particular blade being used.

With the present invention, a method and apparatus is provided for adjusting a variety of different blades so as to maintain the tip or active edge of the blade in a constant position and at a constant angle with respect to the web being coated.

These and other aspects of this invention are illustrated in the accompanying drawings and are more fully described in the following specification.

BRIEF DESCRIPTION OF THE DRAWINGS

FIG. 3 schematically illustrates a curvature the blade assumes as it is progressively adjusted to higher tip pressures; and FIG. 4 illustrates one of the curves empirically established for controlling the movement of the jaws when adjusting a specified coater blade.

DETAILED DESCRIPTION OF THE DRAWINGS

Figure 1:
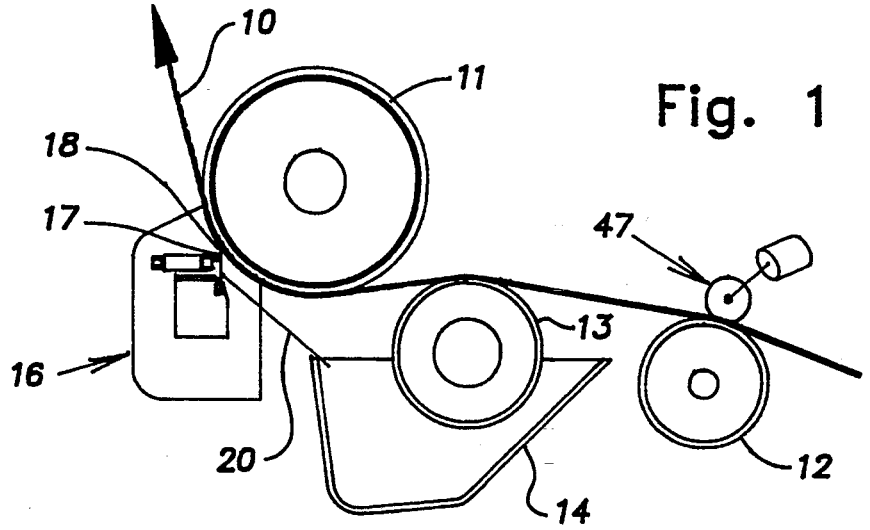
FIG. 1 is a fragmentary schematic view of a coating machine incorporating the present invention with parts removed for purposes of clarity.

FIG. 1 schematically illustrates a web coating machine, in accordance with the present invention. In such machine a web 10, such as a web of paper, is carried around a back-up roll 11. Before reaching the back-up roll 11, the web 10 passes over a positioning roll 12 and an applicator roll 13. Located below the applicator roll is a reservoir 14 containing the coating material which is applied to the web 10 by the applicator roll 13.

Positioned on the side of the web opposite the back-up roll 11 is a doctor or coating blade assembly 16. This assembly provides a doctor or coater blade 17 having a tip or an active edge 18 engaging the side of the web 10 opposite the back-up roll 11. The active edge 18 of the blade presses against the adjacent surface of the web and functions to press the coating material into the web and remove any excess coating material so that the web is provided with a desired coating and finish as it passes the blade 17. Excess coating material is returned to the reservoir 14 by an inclined pan 20.

The blade assembly 16, in accordance with the present invention, provides means for adjusting the force applied by the active edge 18 to the coating and web while maintaining the active edge in a precisely constant position with respect to the web and backing roll. Further, the adjusting means provided by this invention function to automatically maintain the constant angle between the active edge and the backing roll and web. In addition, the present invention provides automatic compensation for wear of the blade 17.

The blade assembly 16 includes a frame 19 mounted for pivotal movement about an axis 21 which is coincident with the point of contact between the active edge 18 of the blade and the web 10. Mounted on the frame 19 is a fulcrum 22 which engages one side of the blade 17 at a location spaced from the active edge 18. Also mounted on the frame 19 is an adjusting assembly 23 for adjusting the pressure exerted by the active edge 18 of the blade 17 against the web 10. This assembly includes a first slide 24 mounted for movement relative to the frame 19 in a first direction indicated by the arrow 26. In the illustrated embodiment, this is the "Y" direction and is parallel to the plane of the blade in its unstressed condition. Bearings 27 schematically indicated by the inclined hash lines at 27 confine the movement of the first slide 24 relative to the frame to linear movement in the direction of the arrow 26.

A second slide 28 is carried by the first slide 24 by bearings schematically illustrated at 30 for movement relative to the first slide in a second direction indicated by the arrow 29. In the illustrated embodiment, the direction of the movement of the second slide 28 relative to the first slide is perpendicular to the direction of the movement of the first slide 24 relative to the frame 19 and is the "X" direction of movement.

The second slide 28 provides jaws 31 which clamp the edge 32 of the blade 17 remote from the active edge 18.

A first servo actuator 33 is connected to the frame 19 and is operable to pivot the frame 19 about the axis 21 in response to control signals supplied by a computer-type controller 34. A second servo actuator 36 is connected between the frame 19 and the first slide 24 and is operable to move the first slide back and forth relative to the frame 19 in the direction of the arrow 26. Here again, the operation of the second servo actuator is controlled by the controller 34.

A third servo actuator 37 is mounted between the first slide 24 and the second slide 28 and is operable to move the second slide 28 relative to the first slide 24 back and forth in the direction of the arrow 29. Here again, the operation of the third servo actuator is controlled by the controller 34.

Although various types of servo actuators can be utilized, it is preferred that each of the servo actuators 33, 36 and 37 include a motor-driven screw and nut device, such as a precision ball screw, in which the motor is controlled by the controller 34, both as to the direction of the motor drive and the amount of movement provided by the motor in response to a given signal. Preferably, the servo actuators are capable of increments of movement in the order of 0.00025 inches. Typically, such servo unit also provides a feedback to the controller 34.

Because the first direction of movement 26 is angulated with respect to the second direction of movement 29 (perpendicular in the illustrated embodiment), the controller 34 is capable of causing the movement of the jaws along substantially any curve or path of movement within the limits of travel of the two slides 24 and 28.

In the illustrated embodiment, the unstressed blade 17 is installed in the jaws so that the active edge 18 engages the web 10 at the desired location which is coincident with the pivot axis 21 of the frame 19. In such position in the illustrated embodiment, the first or "X" direction of movement 29 is in the direction perpendicular to the plane of the blade 17 when the blade is unstressed and flat, and the second or "Y" direction of movement 26 is parallel to such plane. Further, the fulcrum 22 is adjusted to engage the side of the blade 17 at a point spaced from the active edge 18. This distance is normally referred to as the distance of tip extension and is indicated in FIG. 3 by the bracket 38.

Figure 2:
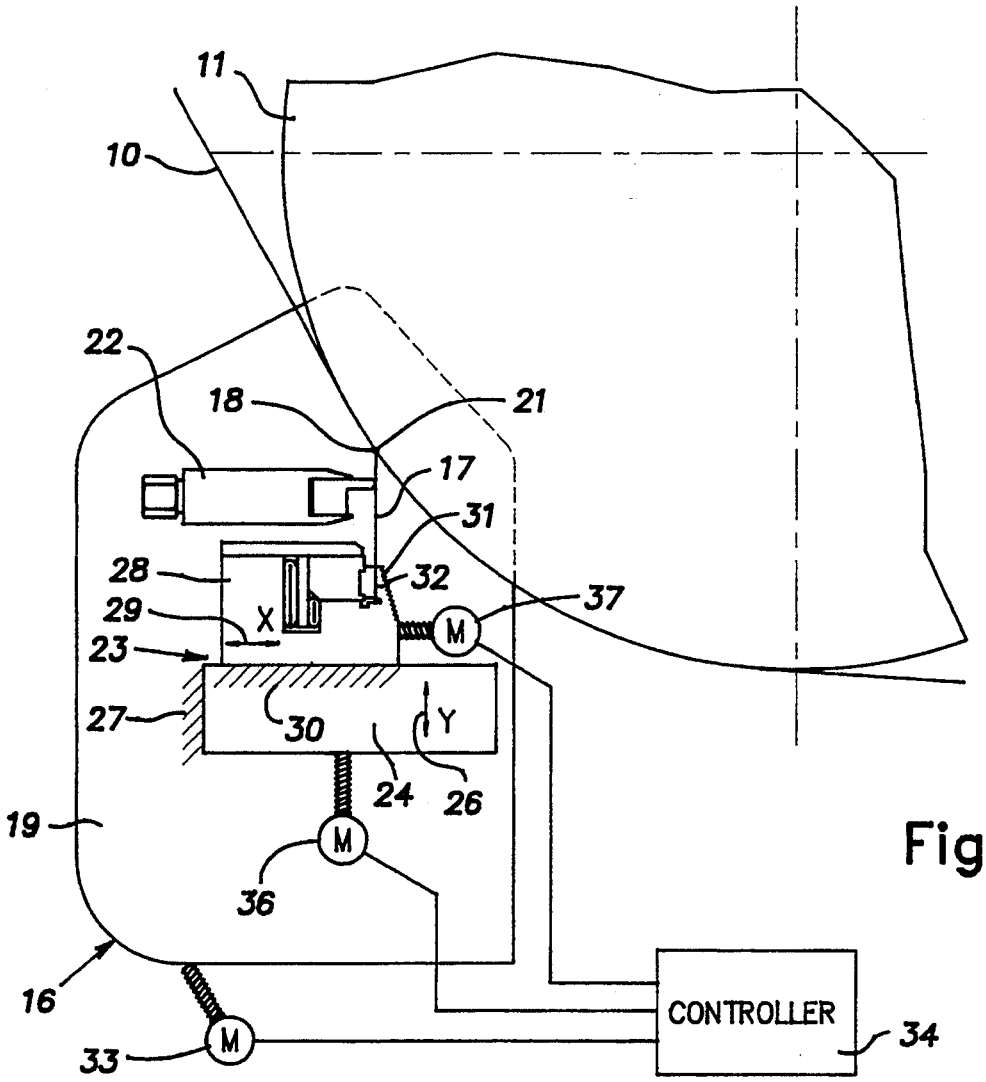
FIG. 2 is a schematic view illustrating the blade support structure and the manner in which the blade is adjusted.

FIG. 3 indicates the manner in which the pressure of the blade 17 is adjusted, in accordance with the present invention. Referring to FIG. 3, the jaws 31 are moved in a curved direction which operates to maintain the active edge 18 of the blade 17 in a fixed position against the web 10 on the side thereof opposite the back-up roll 11. The controller 34 (illustrated in FIG. 2) coordinates the distance the jaws 31 move in the "X" direction 29 with the distance of simultaneous movement of the jaws in the "Y" direction 26 so as to maintain the active edge 18 in a fixed location. Because the jaws 31 remain in a fixed orientation with respect to the frame 19 and the fulcrum 22, the blade assumes a generally "S" shape as the adjustment operates to increase the pressure of engagement between the active edge 18 and the web 10.

FIG. 3 progressively illustrates the deformation of the blade 17 as the servo actuators 36 and 37 are operated to increase the pressure. During the first portion of adjustment illustrated by the blade curvature 17*a*, the "S" shape is shallow, but as the adjustment proceeds through the positions indicated by the curves 17*b* to the position of the curves 17*c*, the "S" curvature increases. As a consequence, the effective length of the blade decreases as the adjustment proceeds.

As used herein, the effective length of the blade in any given position of adjustment is equal to the distance between the inner ends of the jaws at 41 and the active edge 18 of the blade, taken along the "Y" direction 26 parallel to the unstressed plane of the blade 17 before adjustment. The initial effective length is indicated in FIG. 3 by the distance "A". The effective length when the blade has been deflected to the position indicated by the curve 17*c* is indicated in FIG. 3 by the distance "Ac", which is substantially smaller than the initial effective length "A".

If it were not for the movement of the jaws in the direction 26 as the movement of the jaws in the direction 29 progresses, the location of the active edge 18 against the web 10 would not remain constant. Therefore, in the illustrated embodiment, the jaws move along a curved path in which the movement in the "Y" direction 26 is equal to and fully compensates for the change in effective length of the blade so as to maintain the active edge in a fixed location.

In FIG. 3, the condition of the blade as it is progressively adjusted to higher loading conditions is illustrated without corresponding adjustments to maintain the angle of the blade active edge 18 with respect to the web 10 constant. As illustrated in FIG. 3, the portion of the blade extending from the fulcrum 22 to the active edge 18 is also deformed from its unstressed condition and would cause a change in the angle of the active edge 18 with respect to the web if angular adjustment were not provided. This would create an unstable condition in which the active edge would run on its heel until such edge were honed by the engagement with the web 10 to an edge shape corresponding to the new angular position. This would again re-establish a stable condition. However, the coating on the web produced while the unstable condition existed would be an inferior coating. Therefore, the controller also operates the servo actuator 33 to pivot the frame 19 around the pivot axis 21 to maintain the angle of the active edge 18 of the blade constant as the jaws are moved to various adjusted positions. By providing the active edge 18 in exact coincident with the pivot axis 21, adjustment of the frame around the pivot axis 21 does not result in movement of the active edge toward or away from the backing roll. If, as in other designs, active edge 18 and pivot axis 21 are no longer coincident, the effect of rotation about pivot axis 21 causes the tip 18 to either dig the blade tip 18 into backing roll 11, or pull it away from backing roll 11. In either case, the net effect is an undesirable blade angle change coupled with a load change that is more or less than expected.

FIG. 4 illustrates a typical jaw movement curve which functions to maintain the active edge of a blade in a fixed position as the jaws are moved to increase the pressure of the active edge 18 on the web 10. The horizontal scale on the curve represents the movement in the "X" direction 29, and the vertical scale represents the movement in the "Y" direction of jaw movement in the direction 26. The "X" indicates measured points which result from actual tests conducted on full-sized models and machines.

The particular curve illustrated is a loading curve of a 4-inch wide blade 0.018 inches thick having a 45° bevel at the active edge 18, and a 0.875 inch tip extension.

The points represented by the "X" are determined experimentally in the following manner. A magnified scope 46 is positioned so that the active edge 18 of the undeflected blade 17 is located in the cross hairs of the scope. This permits the optical determination of the position of the active edge 18 of the blade during adjustment. The servo actuator 37 is then operated to move the jaws in the direction 29 a small, predetermined distance. This results in the initial movement of the active edge 18 in a downward direction, as viewed in FIG. 3. The servo actuator 36 is then operated in the direction 26 to return the active edge 18 to its previous position as established by the cross hairs within the scope 46. This distance is then determined, and the first plotted point "X" is established. The process is repeated to sequentially establish the remaining points which result in maintaining the active edge 18 in a fixed position as the blade 17 is progressively deformed by the operation of the two actuators.

The referenced points are then supplied to a computer programmed to establish a curve which matches the plotted points as close as possible. It has been determined that such curve can best be described by a third, or in some cases, fourth order polynomial. These polynomials take the following form:

$Y=AX^3+BX^2+CX+D$ for a third order polynomial and $Y=AX^4+BX^3+CX^2+DX+E$ for a fourth order polynomial when X and Y represent the amounts of the first and second movements. It is also possible to develop the curves using finite element analysis software.

The constants thus developed for a given blade are then loaded into the controller and are programmed to move the jaws 31 along the proper curve for the particular blade being used.

At the same time the measurements are being taken to establish the proper curve, the corresponding change in angle of the tip 18 of the blade at the active edge can either be measured or calculated by a person skilled in the art. This information is also supplied to the controller so that as the jaws are moved, the controller functions to operate the servo actuator 33 to pivot the entire frame about the pivot axis 21 which is coincident with the fixed location of the active edge of the blade. This ensures that a stable operation continues, even as adjustments of the pressure are changed, and a high quality coating is applied to the web 10, even when adjustments are being made.

In accordance with the present invention, automatic compensation for blade wear is also provided. It has been established that the blade wear of a particular blade is a function of the length of the web which passes the active edge 18. Therefore, a measuring device schematically illustrated at 47 is provided to determine the length of the web which moves past the blade 17. This measuring device can measure either the actual length of web which moves by the blade 17, or the rate of movement which can then be multiplied by time to give the actual length. The information generated by the measuring device 47 is also supplied to the controller which then makes appropriate changes in the curve of movement of the jaws to compensate also for the wear occurring in the blade. With this invention, it is possible to compensate for blade wear from 0.080 inches to 0.18 inches. In most cases, this means doubling or tripling existing blade life.

The formula used by the controller to establish the curve of movement of the jaws during blade adjustment must be modified whenever:

a. The blade extension is changed;
b. The effective length (A) of the unstressed blade is changed;
c. The blade thickness is changed; or
d. The blade wears.

The number of different formulas which must be supplied with a given machine varies with the number of different types of webs and coatings that are produced and the number of different blade sizes which are expected to be used. Typically, it is necessary to establish from five to twenty sets of curves for a given machine.

With the present invention, a method and apparatus is provided to maintain the exact position and angle of incidence of the active edge 18 of a blade so as to maintain a high quality coating output, even when blade adjustments are required. Further, with the present invention, automatic adjustment is provided to compensate for blade wear. Further, since substantial adjustment movements can be made wider and thinner, more flexible blades can be used which reduce damage to the web when holes or other imperfections in the web pass the blade. Also, this invention can be applied to flooded nip coaters and jet fountain coaters.

Although the preferred embodiment of this invention has been shown and described, it should be understood that various modifications and rearrangements of the parts may be resorted to without departing from the scope of the invention as disclosed and claimed herein.

What is claimed is:

1. A method of adjusting a beveled edge coating blade in a web coating machine comprising positioning the active edge of said blade in a selected position for controlling application of a coating to a web, positioning a fulcrum against said blade at a location spaced from said active edge, clamping the other edge of said blade in jaws, moving said jaws with independent linear translating movement in two directions at angles relative to each other to cause a "S" shaped deflection in said blade while moving said jaws along an empirically established curve based on blade characteristics which maintains said active edge in said selected position, and coordinating the movement of said jaws in said two directions so that said jaws move along said curve and adjust a pressure of said active edge on said web while maintaining said active edge in said selected position.

2. A method as set forth in claim 1, including establishing said two directions perpendicular to each other.

3. A method as set forth in claim 1, including supporting said fulcrum and said jaws on a frame pivoted for movement about an axis through said selected position, and moving said frame around said axis to maintain the constant angle between said active edge and a web passing said active edge.

4. A method as set forth in claim 1, including establishing said curve by deflecting a test blade having the same dimensions as said blade in a full scale model of said web coating machine to obtain a plurality of points along said curve.

5. A method as set forth in claim 4, including establishing a polynomial formula substantially fitting said points.

6. A method as set forth in claim 5, including deflecting a series of test blades having different dimensions to establish a polynomial formula having a set of constants for each test blade, and supplying said set of constants to a controller operating to regulate the relationship between said movements in said two directions required by said blade.

7. A method as set forth in claim 5, including establishing a constant for a polynomial which is at least a third order polynomial.

8. A method as set forth in claim 6, including establishing the rate of wear per unit length of web passing said blade, supplying said controller with said rate of wear information, and supplying said controller with a measurement of length of web passing said blade causing said controller to modify said curve to compensate for said wear.

* * * * *